United States Patent [19]

Manning

[11] 4,203,097

[45] May 13, 1980

[54] POOL ALARM DEVICE

[75] Inventor: John J. Manning, San Jose, Calif.

[73] Assignee: RMR Systems, Inc., San Jose, Calif.

[21] Appl. No.: 956,379

[22] Filed: Oct. 31, 1978

[51] Int. Cl.[2] ..... G08B 21/00

[52] U.S. Cl. ..... 340/566; 340/620

[58] Field of Search ..... 116/107, 108; 9/8.3 R, 9/8.3 E; 340/566, 620; 200/84 R

[56] References Cited

U.S. PATENT DOCUMENTS

| | | | |
|---|---|---|---|
| 3,636,544 | 1/1972 | Codina | 340/566 |
| 3,732,556 | 5/1973 | Caprillo et al. | 340/566 |
| 4,017,842 | 4/1977 | Vineyard | 340/566 |

*Primary Examiner*—Thomas A. Robinson

*Attorney, Agent, or Firm*—Hopgood, Calimafde, Kalil, Blaustein & Lieberman

[57] ABSTRACT

A device for indicating a disturbance in a liquid medium, which is especially useful for providing an alarm when a child falls into a swimming pool, comprises a buoyant member carrying a first conductive member, a second conductive member spaced and normally unconnected to the first conductive member, and an alarm circuit. The conductive members are connected to the alarm circuit such that when the liquid in which the buoyant member is floating is disturbed by a predetermined amount, the conductive members are brought into contact through the disturbed liquid, thereby to activate the alarm.

3 Claims, 3 Drawing Figures

POOL ALARM DEVICE

The present invention relates generally to alarms, and more specifically to pool alarms, which provide a warning when a small object, such as a child or an animal, falls into a pool.

In recent years, many persons have acquired swimming pools for their homes. One of the attendant dangers in owning a swimming pool is that a child or a small animal who is incapable of swimming may fall into the pool and drown. Drownings in home pools have become so prevalent that many persons have been dissuaded from purchasing a swimming pool, despite the immense enjoyment that a pool can offer.

Pool owners have tried various means of reducing the danger of drownings in an unattended pool by constructing fences around the pool, boarding over or otherwise covering the pool, or draining the pool. Even when an adult is present at or near the pool, he may not be aware that a child who is incapable of swimming has fallen into the pool, often because the adult is not looking at the pool, cannot hear the splash, or the drowning child does not cry out for help. Despite all of these precautions, swimming pools continue to be dangerous, and an inexpensive, reliable, and uncumbersome method of preventing drownings is still needed.

One way that has been proposed to prevent drownings in swimming pools has been the use of alarms, which are actuated when an object falls into the pool. Such alarms, however, are generally complex and expensive, and somewhat unreliable, and have, accordingly, not been widely used by pool owners despite their potential for saving lives. Another defect of the known pool alarms is that they are often activated when an object such as a twig or stone falls into the pool causing an unnecessary disturbance and inconvenience to the pool owner and his neighbors.

Accordingly, an object of the present invention is to provide vide an improved, reliable, and inexpensive alarm for indicating a disturbance in a liquid medium, such as a pool.

Another object of the present invention is to provide an alarm of the type described which is capable of indicating a disturbance of a minimum magnitude in a liquid medium.

A general object of the present invention is to provide an alarm that is actuated for alarm when an object such as a small child falls into a swimming pool.

The present invention provides for the activation of an alarm upon the occurrence of a disturbance in water such as when a child or the like falls into a swimming pool. The alarm comprises a float carrying a first conductive member, a second conductive member normally spaced from the first member, and an alarm device. The conductive members are each electrically connected to the alarm device such that when the water is sufficiently disturbed, the first and second conductive members are electrically connected through the water, which then contacts both conductive members, thereby activating the alarm device to enable others to come to the rescue of the drowning child.

In another aspect of the invention, the sensitivity of the alarm to a water disturbance can be adjusted to prevent the alarm from being actuated by minor disturbances such as a falling twig, wind, or the like. To this end, several axially spaced second conductive members are arranged about the periphery of the float and only a selected one of these members is connected through a sensitivity control switch to the alarm along with the spaced first conductive member. The sensitivity of the alarm is increased by connecting the alarm through the sensitivity control switch to a lower one of the second conductive members, and decreased by connecting the alarm through the switch to a higher one of the second conductive members.

A more complete understanding of the present invention and the attendant advantages thereof will be apparent from the following detailed description when considered in conjunction with the accompanying drawings, wherein.

Figure 1:
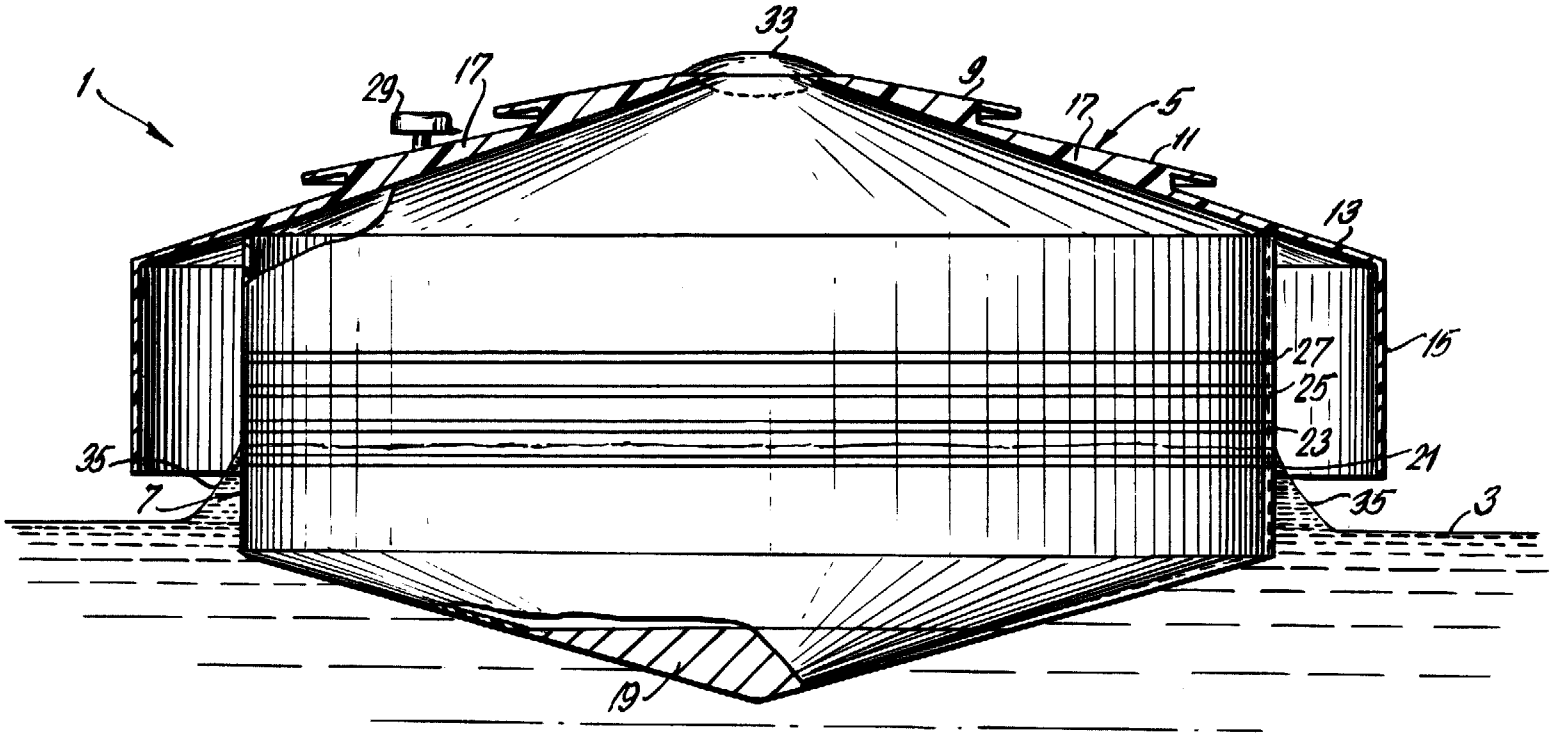
FIG. 1 is a side elevation, partly in section, of a pool alarm according to one embodiment of the invention.

The pool alarm of the present invention includes a body 1 capable of flotation in an electrically conductive medium 3, preferably water. In the embodiment of the invention herein shown, the body 1 is preferably generally cylindrical or spherical in shape and comprises an upper section or cap 5 and a lower section or tunk 7. The cap 5 comprises a series of roofs or louvers 9, 11, 13, concentrically arranged about the cap 5 and a protective bumper 15 which extends from the outer peripheral edge of the lowest roof 13. Each of the roofs 9, 11, 13 is vertically separated from an adjacent roof by spacers 17. The end of the middle roof 11 radially extends beyond the interior edge of the lowest roof 13, and the end of the upper roof 9 radially extends beyond the interior edge of the middle roof 11.

The trunk 7 of the alarm carries a plurality of axially spaced conductive members 19, 21, 23, 25, 27 disposed about its periphery. The conductive members 19, 21, 23, 25, 27 may be formed of electrically conductive metal stripes secured to the outer surface of the trunk 7 or by stripes of conductive paint. A first conductive member 19 is affixed to the bottom of the trunk 7 of body 1, which as shown in FIG. 1, is in the shape of an inverted pyramid as viewed in cross section. When the pool alarm of the invention is placed in a body of water 3, the first conductive member 19 rests below the water surface. The second group of conductive members 21, 23, 25, 27 may also be disposed about the inside periphery of the bumper 15.

Figure 2:
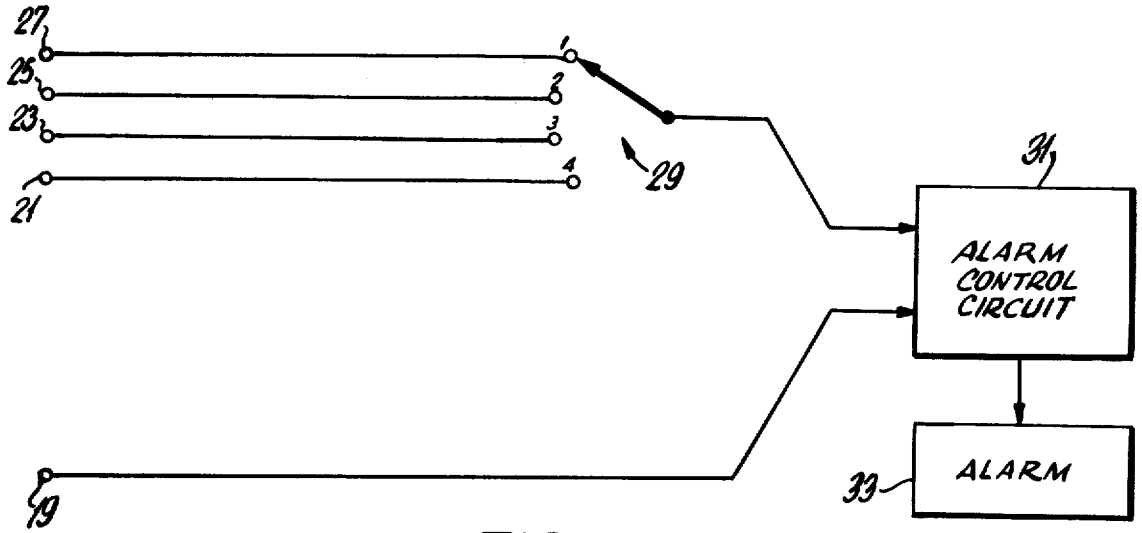
FIG. 2 is a schematic diagram of the electric circuit that may be used in the pool alarm of the invention.
Figure 3:
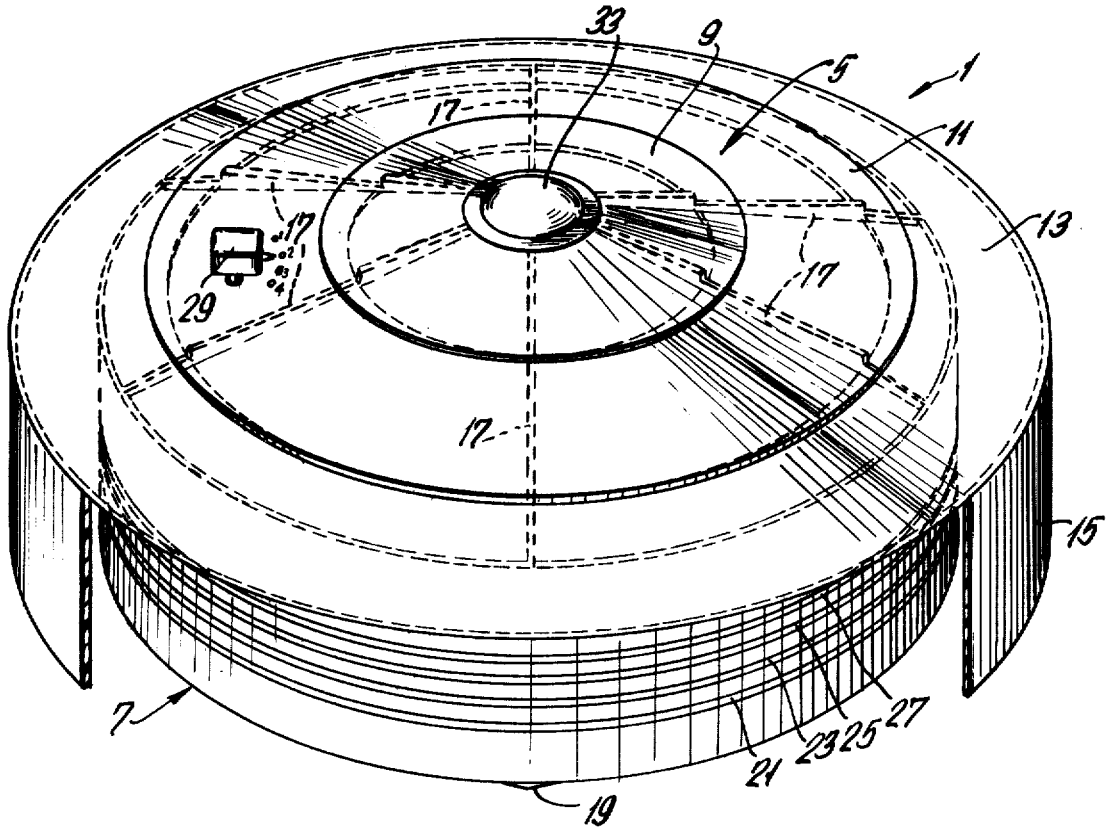
FIG. 3 is a perspective view, partly in section, of the pool alarm of the invention.

The body 1, and preferably the cap 5 of the body 1, contains a package or module which contains an electronic alarm control circuit. As schematically shown in FIG. 2, the alarm control circuit 31 is connected to a sensitivity control switch 29, and to an alarm 33 which may be a siren, whistle, bell, or the like powered by means (not shown) such as a battery. A selected one of the second conductive members 21, 23, 25, 27 is electrically connected through the switch 29 to the alarm control circuit 31, which is also unconditionally electrically connected to the first conductive member 19. Whenever the second conductive member which is connected to the switch 29 is also connected to the first conductive member 19 through a wave, or water such as 35, which is of sufficient magnitude or height to rise to the level of the second conductive member, such as when a child falls into the pool, and thereby contact both conducting member 19 and the selected one of the second conductive members (21 in FIG. 1), the alarm device 33 is activated. The switch 29 may be selectively connected to any of the second conductive members 21, 23, 25, 27 to adjust the sensitivity of the alarm to disturbances of different levels as will be described in greater detail below.

The alarm circuit 31 may also include, if desired, a latching device, such as a UJT or SCR, which once turned on remains conductive until the alarm is turned off. The alarm circuit may also include an oscillator of one frequency which modulates an oscillator at a higher frequency so that the alarm signal, when produced, is at a steadily varying tone.

In the operation of the pool alarm of the present invention, a disturbance of the liquid 3 in which the alarm floats creates a series of waves, which rise above the surface of the pool. When one of the waves, such as wave 35, is of a sufficient height to simultaneously connect the second conductive member that is connected to the switch 29 and the first conductive member 19, which remains in contact with the liquid 3, the two conductive members are brought into electrical connection through the liquid, which completes the alarm circuit 31 and thereby activates the alarm device 33.

It will be understood that the magnitude of the disturbance in the liquid 3 will determine the magnitude of the waves 35 produced by the disturbance. Since the second conductive members 21, 23, 25, 27 are vertically spaced from each other, the switch 29 is connected to one of these conductive members to select the amount of disturbance, i.e., the height of the wave that will be necessary to activate the alarm device 33. More particularly, a greater magnitude of disturbance or wave height is required to activate the alarm device 33 when the switch 29 electrically connects one of the upper second conductive members, as opposed to one of the lower ones of the second conductive members, to the alarm circuit.

The alarm of the invention can thus by the proper setting of the sensitivity control switch 29 be set to be actuated only upon disturbances exceeding a minimum magnitude and to ignore or remain unaffected by disturbances of lesser magnitudes. Consequently, the pool alarm of the invention can be set by the proper setting of the sensitivity control switch to ignore minor disturbances caused by such things as wind action upon the liquid or twigs falling on the water, and yet indicate significant disturbances caused by such things as a child falling into the pool.

The overlapping vertically separated roofs 9, 11, 13, of the cap 5 prevent rain from entering the interior of the body 1, while at the same time permitting sound to escape from the interior of the body 1. The bumper 15 on the bottom roof 13 protects the second conductive members 21, 23, 25, 27 from rain and also prevents them from contacting the edge of a swimming pool or the like.

Thus, the alarm of the present invention provides an inexpensive, reliable, and relatively simple method for indicating the occurrence of a disturbance in a liquid, which can be utilized to prevent drownings in a pool by providing an alarm indication whenever a child or animal, for example, falls into the pool.

It will be clear to those skilled in the art that modifications and variations of the above-described preferred embodiment may be made without departing from the spirit and scope of the invention.

What is claimed is:

1. An alarm for indicating a disturbance in an electrically conductive liquid medium, said alarm comprising:

a body capable of flotation in the liquid medium;

a first conductive member carried on a lower portion of said body and adapted to be normally immersed in the liquid medium;

a plurality of vertically and axially spaced second conductive members arranged about the periphery of said body and vertically and axially spaced from and normally out of electrical contact with said first conductive member and adapted to be normally out of contact with the liquid medium in the absence of a disturbance in the liquid medium;

alarm means operatively electrically connected to said first conductive member and to a selected one of said second conductive members such that upon a disturbance of the liquid medium exceeding a minimum predetermined level, said first conductive member and said selected one of said second conductive members are brought into electrical connection through the liquid medium, thereby to activate said alarm means; and switch means for connecting said alarm means to said selected one of said second conductive members, thereby to select the minimum magnitude of a disturbance in the liquid medium required to electrically connect said first and second conductive members to actuate said alarm.

2. The alarm of claim 1, wherein said selecting switch means comprises a switch having a contact operatively electrically connected to said alarm means, and means for electrically connecting said contact with a selected one of said second coductive members.

3. The alarm of claim 1, wherein said body is a hollow member made of electrically insulating material and said second conductive members comprise stripes of conductive material on the periphery of said body.

* * * * *